United States Patent [19]

Röben

[11] Patent Number: 4,648,719

[45] Date of Patent: Mar. 10, 1987

[54] COLLOIDER FOR COLLOIDIZING FLOWABLE MATERIALS

[75] Inventor: Wilhelm Röben, Zetel, Fed. Rep. of Germany

[73] Assignee: Roben Kolloid Entwicklung GmbH & Co. KG., Zetel, Fed. Rep. of Germany

[21] Appl. No.: 728,750

[22] Filed: Apr. 30, 1985

[30] Foreign Application Priority Data

Jan. 23, 1985 [DE] Fed. Rep. of Germany ..... 3502153

[51] Int. Cl.[4] ..... B01F 3/12

[52] U.S. Cl. ..... 366/143; 241/46.17; 366/177; 366/185; 366/192; 366/314

[58] Field of Search ..... 366/45–47, 366/64, 65, 185, 192, 205, 193, 314, 143, 177, 132, 137, 98, 100; 241/46.17, 101 B, 97, 284

[56] References Cited

U.S. PATENT DOCUMENTS 4,101,977 7/1978 Brackman ..... 366/185 X

FOREIGN PATENT DOCUMENTS 3306071 8/1984 Fed. Rep. of Germany .

*Primary Examiner*—Timothy F. Simone

*Attorney, Agent, or Firm*—Scully, Scott, Murphy & Presser

[57] ABSTRACT

The colloider comprising a collecting tank, the top area of which is suitably designed for receiving the materials, also includes a rotor which is rotatably mounted in the bottom area of the collecting tank and acts as an influence means.

To provide a colloider which, for cleaning purposes and repair as well as for material supply and discharge, has a well accessible collecting tank interior and the space requirements and weight of which are low, the colloider comprises a rotor drive shaft which is passed through the bottom of the collecting tank including an opening adapted to be closed by means of a cover and provided in the top area of the collecting tank and is optionally movable into an operating position with the opening being at the top, and into a draining position, with the opening being at the bottom then.

32 Claims, 5 Drawing Figures

COLLOIDER FOR COLLOIDIZING FLOWABLE MATERIALS

BACKGROUND OF THE INVENTION

1. Field of the Invention

This invention relates to a colloider for colloidizing flowable materials comprising a collecting tank, the top area of which is suitably designed for receiving the materials and a rotor which is rotatably mounted in the bottom area of the collecting tank and acts as an influence means.

2. Discussion of the Prior Art

DE-OS No. 33 06 071 discloses an apparatus for producing high-quality solid-and-liquid mixtures. A cylindrical collecting tank is provided with a vane-type rotor adapted to be motor-driven. The drive unit is positioned above the collecting tank. The drive shaft is passed through an upper closing wall into the tank interior. Diametrically opposing rotor blades are positioned at the lower free drive shaft end. A discharge opening is provided in the bottom area of the collecting tank and is adapted to be closed by means of a gate.

A pipe system connected to said discharge opening either ensures that a non-colloidal mixture can be returned to the collecting tank or that a ready-made mixture can be discharged. In the case of such a coaxial arrangement of the drive unit on top of the collecting tank, the tank interior is not freely accessible.

Consequently, it is more difficult to clean the container and repairs necessary at the rotor, the drive shaft or the tank interior require a time-consuming disassembly. In addition, the drive unit takes up much space at the top of the collecting tank and thus only a limited area remains for introducing the materials into the container.

Upon mechanical influence on the materials to be processed, extremely high forces and moments occur at the rotor blades and the drive shaft extending far into the collecting tank interior. Hence, the known assembly having a drive shaft entered into the collecting tank from the top is expensive and requires high constructive and structural expenditure.

It is an object of the present invention to improve a colloider of the type set forth in the introduction so as to ensure that the materials can quickly and easily be filled in and discharged, with the construction of the colloider being nonetheless simple, that the tank interior is easily accessible for cleaning and repair, that the weight of the colloider and its space requirements are low and its functioning particularly reliable.

SUMMARY OF THE INVENTION

In accordance with the invention this object is attained by the characteristics that the rotor drive shaft is passed outwards through the bottom of the collecting tank, that the collecting tank includes an opening adapted to be closed by means of a cover and provided in the top area of the collecting tank, and that the colloider is designed so as to be optionally moved into an operating position, with the opening being at the top, and into a draining position, with the opening being at the bottom then.

The advantages of the colloider according to the invention with regard to the state of the art are substantial. The drive shaft of the influence means passed outwards through the bottom of the tank is of a lightweight construction. The drive shaft forms a short lever to keep the forces and moments to be transmitted low. In addition, it is ensured by this shaft arrangement that there is enough space within the tank for the materials to be processed, while a drive shaft passed into the tank from the top and mounted within a supporting tube decreases the actual volume of the collecting tank. Another advantage offered by the characteristic that the drive shaft is passed outwards in the bottom area of the collecting tank results from the fact that a large-diameter opening may be provided in the top area of the collecting tank which ensures a good access to the tank interior and is adapted to be closed by means of a cover during operation. Owing to the fact that the drive shaft is passed outwardly through the tank bottom and the thus achieved good access is enough space for unobstructedly filling the materials through the cover into the center of the collecting tank. The pivotal arrangement of the tank ensures that a ready-made colloidal mixture can quickly and easily be discharged from the tank by swinging it from its operating position, with the opening being at the top, into a draining position, with the opening being at the bottom.

A preferred configuration of the colloider according to the invention is attained by the fact that the ratio of the height of the collecting tank to its inner diameter ranges from 0.70 to 2.5. Observing this ratio effectively supports turbulent stream production within the tank when a colloidal mixture is manufactured.

Another advantage can be seen in the design of the colloider according to the invention such that the ratio of the inner diameter of the collecting tank to the diameter of the rotor ranges from 1.10 to 2.25. The effect of such a ratio can be seen in that all particles of the mixture are accelerated by the rotor action and in that there remain no deposits on the inner walls of the collecting tank.

A peripheral speed necessary for the production of a colloidal mixture is advantageously defined by the fact that the rotor speed, depending on its design, ranges between 1.500 and 12.000 r.p.m.

A preferred modification of the colloider according to the invention is attained by the characteristic that the rotor includes at least two vanes. To design the influence means as a vane-type rotor constitutes a cost-saving solution, since simple structural members can be employed. Another cost-saving advantage is attained by the fact that the vanes are respectively formed as simple plates.

With the aid of the setting angle of the vanes it will be possible to influence the motion of the mixture particles in the direction of the rotor axis when a colloidal mixture is produced. It will be advantageous to set the angle of each vane within the range of from 2° to 18°.

Another advantageous design of the colloider according to the invention is attached by the fact that each vane has a setting angle that varies over its longitudinal extension. The result is an optimum flow behaviour of the flowable materials inside of the colloider during operation. Such an optimum flow may be predetermined, for instance by a mathematical computing program, so that this flow behaviour can be realized in any case by an adequate setting angle of each vane. It is particularly advantageous in this connection that the setting angle reaches a maximum value in the area of the rotation axis and decreases toward the vane tip.

In case of such a vane configuration a maximum gradient would consequently be attained in the vicinity of the rotation axis and a minimum gradient would result at the vane tip. Hence, it is possible that virtually equal feed and equal acceleration is applied to the individual particles of the flowable material by the entire vane along its entire length. A setting angle too small in the area of the rotation axis would express that there is virtually no thrust or suction in that area, if the conditions are unfavourable, whereas the thrust or suction generated by the rotor at the vane tips and the acceleration the particles undergo would be too high.

It also proves to be particularly advantageous if the setting angle of the vanes is variable, a point that may be attained by various structural measures. However, it may be also possible, in principle, to change the setting angle during colloider operation or to modify the setting angle, on the other hand, by mechanically changing it prior to colloider start.

A collecting tank configuration particularly advantageous for the manufacture of a colloidal mixture is attained when a dynamically balanced (i.e. of rotational symmetry) body tapering toward the tank interior is provided coaxially to the rotor, at that rotor side facing the collecting tank interior. Such a flow-favouring configuration of the deflector means permits the turbulent motions generated within the mixture when a colloidal mixture is manufactured to be shaped such that the cross-sectional area has the form of a lemniscate. High particle velocities within the mixture to be treated are ensured by such a form of the eddy.

An advantageous modification of the colloider according to the present invention is also attained by the characteristic that the distance between the rotor and the collecting tank bottom is variable. It is possible to adapt such a colloider type in an optimum manner to various amounts to be filled in and to various filling materials and consequently, the colloider according to the invention offers a broad variety of application. There are various possibilities of adjusting the rotor height such as, for example, descending the collecting tank relative to the rotor or shifting the rotor along its rotation axis in a telescopelike manner. This height adjustability always ensures optimum flow and turbulence conditions within the collecting tank of the colloider for any amount to be filled in and for any filling material.

To achieve an optimum functioning of the colloider, the ratio of the collecting tank diameter to the distance between the vanes and the tank bottom is set within the range of from 4 to 25. This ratio is to be based on the inner diameter of the collecting tank in case the tank is of a substantially cylindrical configuration, whereas the aforementioned ratio is to be determined on the basis of the diameter present in the rotational plane of the rotor and its vanes, respectively, in case the collecting tank is not of a cylindrical shape.

Another particularly advantageous configuration of the colloider according to the invention is attained by the characteristic that the collecting tank is provided with at least one material supply system and one material discharge system, both being adapted to be closed. Said material supply and discharge systems can either be positioned in the bottom area,in the transitional zone between bottom and side wall or within the side wall of the collecting tank; it may be also possible to locate material supply system and material discharge system at different points of the collecting tank. Such a configuration of the colloider permits a quasi-statioary operation, which means, individual charges are fed into the colloider and removed therefrom respectively after processing without it being required to turn off the rotor drive. This principle of quasi-stationary operation may in this case be exclusively ensured by the aforementioned way of material supply and discharge; however, it may be also useful to charge the colloider by means of such a material supply system and to discharge the flowable material after treatment by tipping the collecting tank. On the whole, there is a broad variety of combination possibilities all of which improve the all-purpose field of application of the colloider according to the invention.

Another advantageous configuration of the colloider according to the invention is offered by the characteistic that a material supply system, adapted to be introduced into the collecting tank from the top, is provided for feeding material into the zone of intense rotor action. Consequently, additional material such as, for example, loading materials can be supplied to the zone of intense rotor action during colloider operation. Since a quasi-stationary state of the flowable materials inside of the colloider occurs during its operation, it is possible to supply the loadings to the so-called "suction zone" of the rotor. Therefore, a movable arrangement of the material supply system is particularly advantageous, since the point of loading material supply may be easily adapted to the respective amount of material to be filled in and to the respective filling material. Depending on the field of application, said material supply system introduced from the top may be employed individually or in connection with the material supply and discharge described hereinbefore. It is possible to add loading materials in both cases, that is, when the colloider is charged and discharged according to the principle of quasi-stationary operation and when charging and discharging takes place according to the principle of normal colloider operation. Owing to the fact that the material is supplied from the top, it is further possible to feed even water vapour having temperatures above 100° C. instead of loading materials among which also the addition of water of different temperatures, for example, above 70° C. is to be counted. Depending on the field of application, such a supply of water vapour may cause a more rapid solidification of the flowable material or a "nucleation" in the material analogous with the solidification in metals. Water vapour supply may also cause a deterioration of germs contained in flowable materials or may be employed for like purposes.

It proves to be advantageous that the material supply system projects into the container only when the system is also applied, but is removed when the system is not required in order to not distrub the colloiding procedure.

In various fields of application of the colloider according to the invention and when the flowable materials to be treated are of a suitable structure, it may be advantageous to eliminate gases contained in the materials during colloider operation. For this purpose a vacuum pump may be provided which is adapted to be brought into co-operation with the collecting tank interior. However, an effective operation of the vacuum pump requires that the collecting tank is sealingly closed by means of the cover. Since a lowering of pressure is caused within the collecting tank interior, the pore volume of the flowable material is reduced prior to or during the colloidizing process to an extent that has never been attained before in the conventional colloiders.

After the colloidizing procedure it is possible by means of said vacuum pump to either reduce the present pore volume or to maintain the pore volume achieved.

Another advantageous configuration of the colloider according to the invention can be seen in the fact that the cover is provided with an inspection glass to enable the operational staff to supervise the procedures inside of the collecting tank during colloider operation; the operators are thus capable of adapting the operational conditions to the respective circumstances and consequently, the colloidizing process is further optimized.

It will be further advantageous to include a cleaning means in the cover of the colloider according to the invention. Such a cleaning means may be operated with the aid of water or compressed air or by means of vapour or any other cleaning agent. To provide the cleaning means in the form of a spraying nozzle is particularly advantageous, since such a nozzle ensures a particularly easy cleaning of the colloider after the materials have been discharged. When such a cleaning means is employed, the possibility of providing the material discharge in the bottom area of the colloider is particularly expedient, however, such a configuration is not necessarily required.

Another advantageous characteristic of the colloider resides in the fact that a displacement member is provided between the collecting tank bottom and the rotor. By means of such a displacement member, the exact dimensions of which may be adapted to the distance between rotor and tank bottom as well as to the diameter of the rotor of the tank, the clearance volume below the propeller can be filled and thus, any undesired deposits of calm material within the clearance volume can be prevented.

Another advantageous modification of the collecting tank of the colloider according to the invention is attained by the characteristic that at least one deflector means is disposed at the inner wall of the collecting tank. Said deflector means is designed so as to divert the mixture particles accelerated by the rotor and migrating in spiral-like paths along the inner tank wall in a flow-favouring manner, which means, at a high velocity and with a reduced loss of energy, and return them to the zone of intense rotor action.

A further advantageous characteristic of the colloider according to the invention can be seen in that the collecting tank is of a bulged configuration. Such a configuration permits the tank shape to be adapted in an optimum manner to the form of flow of the flowable material generated during the colloidizing procedure, with dead zones wherein the material is calm and thus not influenced by the rotor being consequently, excluded.

A simple and low-priced development of the rotor is achieved when all vanes are located in one plane.

Another advantageous characteristic is attained by the fact that the vanes are staggered toward the rotor axis such that a part of the vane facing the inner tank side and a part of an adjacent vane facing the tank bottom are positioned in the same plane which is perpendicular to the rotor axis. Such a vane arrangement ensures that, when the material is treated, the mixture particles ar more intensively fed by the rotor in the direction of the rotor axis and consequently, the flow of the mixture within the container is influenced.

In the rotor area, the inner tank wall is exposed to the greatest mechanical forces applied by the mixture to be treated.

Consequently, an advantageous characteristic is attained by the fact that the collecting tank has a reinforced wall portion in the area of the rotor.

Another advantageous configuration of the colloider according to the invention is attained by the characteristic that the collecting tank, the rotor, the drive shaft and the motor form a unit which is positioned so as to be rotatable about a horizontal axis, preferably extending through the center of gravity of the unit. Hence, simple transmitting elements can be employed between the rotor and the motor.

A more compact embodiment of the colloider according to the invention comprising a simple frame that supports the tank and the motor is attained by the advantageous characteristic that the collecting tank and the motor are coaxially arranged. Another advantageous configuration of the colloider according to the invention, however, can be also attained by the fact that the collecting tank is positioned parallel to the motor and that a transmitting element is located between motor shaft and rotor shaft. A low colloider height can be thus attained and in addition, access to the tank interior is improved.

Another advantageous modification of the colloider is further attained by the characteristic that a stripper member is provided, which is adapted to be inserted into the collecting tank and is movable relative thereto. Said stripper member which functions like a spoon can be used for cleaning the inner tank walls after the material has been discharged from the collecting tank to remove the material adherent to the inner tank walls. If the inner tank walls were contaminated an undesirable disturbence of the flow behaviour of the flowable materials would result during the colloidizing procedure. To ensure the relative movement of the stripper member to the collecting tank, said stripper - preferably spoon-shaped - is suitably designed so as to be rotatable about the axis of symemtry of the tank, however, it may be also possible that the stripper member is stationary and that the collecting tank is suitably caused to rotate. Another advantageous modification of the stripper member is attained by the fact that said stripper is adapated to be additionally acted upon by compressed air or vapour which means, the stripper member is provided with corresponding outlet nozzles and consequently, also the cleaning process is further facilitated.

When the dimensions of the colloider according to the invention are fixed, in particular, when the rotor setting angle, the distance between rotor and bottom, the rotational speed of the rotor as well as the amount of flowable material the colloider is charged with are determined, the specific gravity of the flowable material and of its individual components, respectively, is to be also taken into account. In view of this necessity, the advantages of the colloider according to the invention described hereinbefore prove to be particularly valuable, since the colloider can be employed in many fields.

BRIEF DESCRIPTION OF THE DRAWING

Several embodiments of the colloider according to the invention shall hereinafter be described with reference to the accompanying drawing, wherein.

DESCRIPTION OF THE PREFERRED EMBODIMENTS

Figure 1:
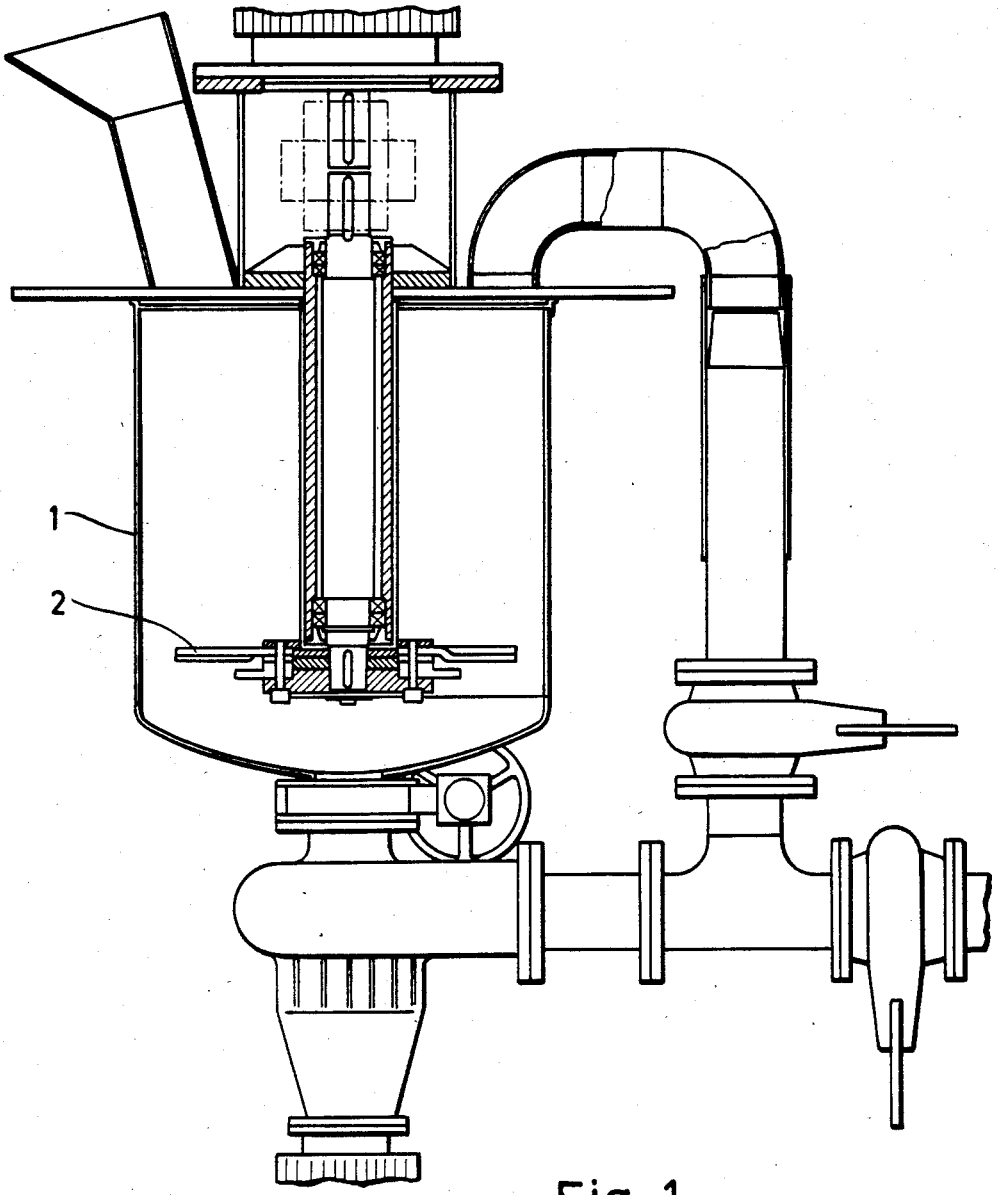
Fig. 1 (PRIOR ART)
FIG. 1 shows a longitudinal section of a colloider according to the state of the art

Structural members acting likewise or in an analogous fashion always have the same reference numerals in the figures.

Figure 2:
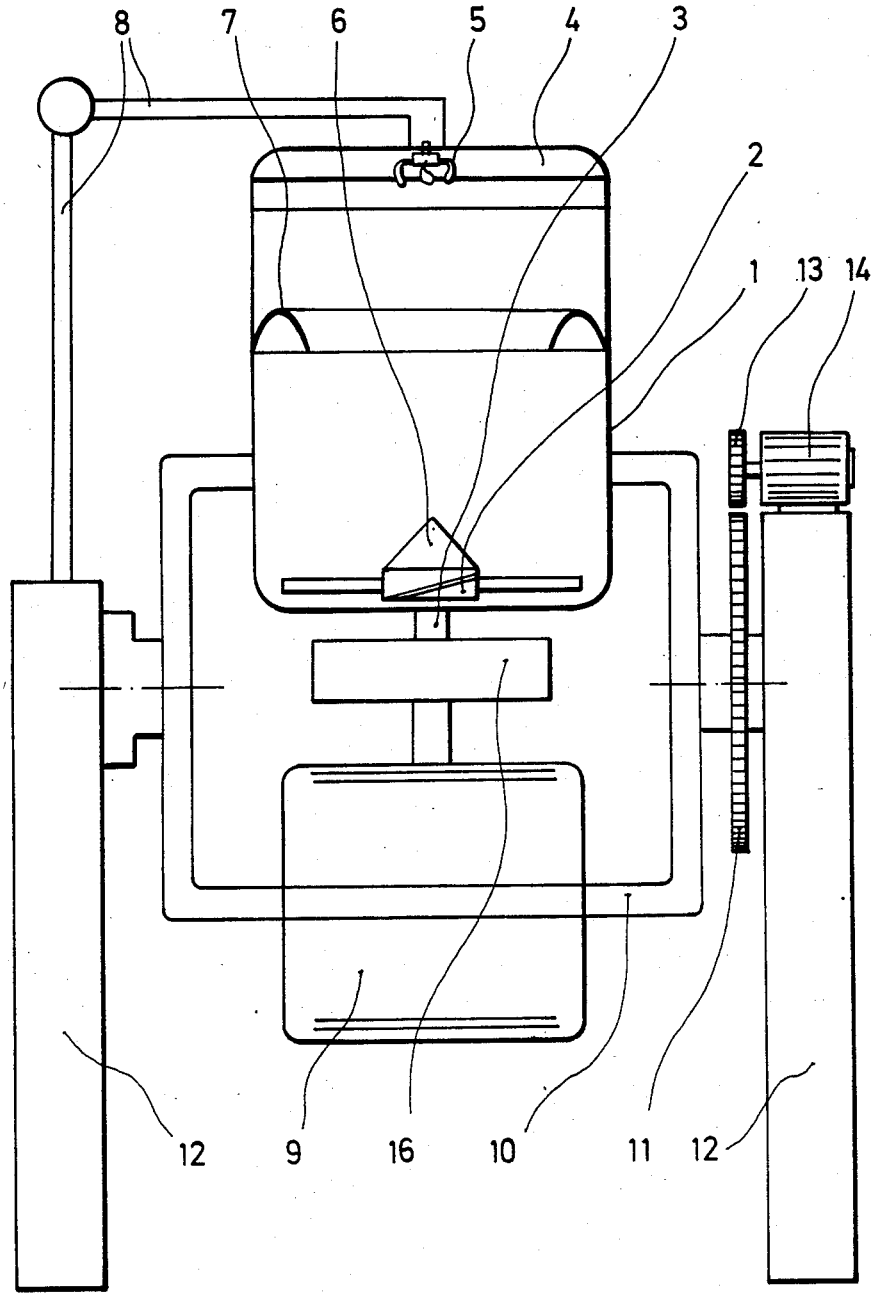
FIG. 2 shows a longitudinal section of a first embodiment of a colloider according to the invention, with the collecting tank and the motor being coaxially arranged

The colloider shown in FIG. 2 includes a collecting tank 1 which is provided with a rotor 2 located in the bottom area thereof, with said rotor being in communication with motor 9 via a drive shaft 3 passed outwards through the tank bottom. Collecting tank 1 and motor 9 are supported in a frame 10 that is rotatably mounted in a stand 12. Collecting tank 1 comprises a cover 4 which includes a cleaning means 5 and is attached to said stand 12 by means of hinged arms 8. Said arms 8 are designed for accommodating the supply pipes required by said cleaning means. Motor 9 and collecting tank 1 are coaxially arranged. A flywheel 16 is positioned between said collecting tank 1 and said motor 9. A toothed gear 11 is fixedly secured to said frame 10 at that side of the frame facing said stand 12. A motor 14 is joined to said stand such that a pinion driven by said motor 14 is in engagement with said toothed gear 11. By means of this assembly, the unit comprising collecting tank and motor is adapted to be swung from an operating position, wherein the tank opening is at the top, into a draining position, wherein the tank opening is at the bottom. Rotor 2 disposed in the bottom area of said collecting tank 1 is a vane-type rotor. Simple plates form the rotor blades. Said rotor includes at least two blades either located in a plane perpendicular to the rotor axis or staggered along said rotor axis such that a part of the rotor blade facing the inner tank side and a part of an adjacent rotor blade facing the tank bottom are still located in a plane that is perpendicular to said rotor axis. Coaxially to said rotor, at that rotor side facing the collecting tank 1 interior, there is provided a dynamically balanced (i.e. of rotational symmetry) body 6 tapering toward the tank interior. Body 6 may be also formed integral with the rotor hub. The tank wall is reinforced in the rotor area. In addition, a deflector means 7 is located at the inner radius of said tank. Deflector means 7 includes one or a plurality of diverting surfaces that are adapted to the inner radius of said collecting tank in an annulus-like fashion and the cross-sections of which approximately have the form of a lemniscate.

The parts located within said collecting tank and subjected to high mechanical forces such as, for example, the rotor blades and the deflector means are positioned within the tank so as to be easily and quickly replaceable. Cover 4 of said collecting tank may be also provided with an inlet port via which the material to be treated is either directly introduced into the central area of the tank or is fed thereinto by means of a filling device. Motor 9 of the colloider that drives rotor 2 located within the collecting tank may be an electric motor adapted to be controlled in response to the state of the mixture.

Figure 3:
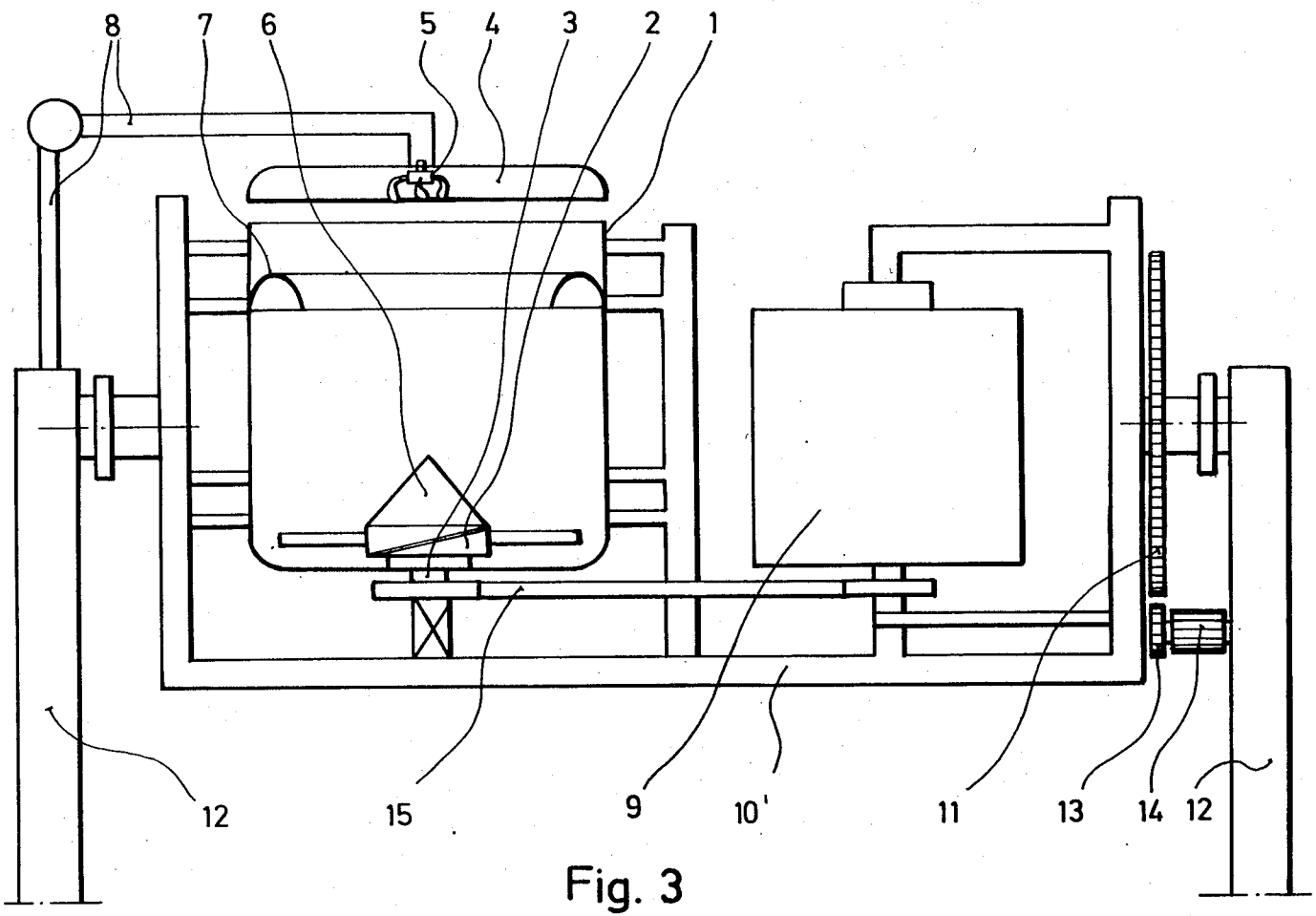
FIG. 3 shows a longitudinal section of a second embodiment of a colloider according to the invention, wherein collecting tank and motor are positioned side by side

The embodiment of the colloider shown in FIG. 3 includes a parallel assembly of collecting tank 1 and motor 9.

The overall height of the colloider will be lowered in this case but such an arrangement also requires another frame 10' for supporting tank 1 and motor 9. A driving belt 15 acts as a transmission element between motor shaft and rotor shaft. Frame 10' is rotatably disposed within said stand 12 as described under FIG. 2.

The embodiments mentioned hereinbefore describe a colloider for converting a solid-and-liquid mixture into a colloidal system with the aid of mechano-physical means. To introduce the material to be mixed into the collecting tank, said tank is swung into its operating position. After the cover has been removed, the solid-and-liquid mixture is entered through the opening now at the top, or the mixture is either directly, or by means of a filling device introduced into the central area of the tank interior into the zone of intense rotor action through an inlet port defined in a suitably formed cover. During the time of preparation the particles of the solid matter undergo high accelerations effected by the rotor blades which result in a comminution of the solids. Since the particles of the solid matter cooperate, a trituration occurs in the continued circulation process of the mixture. The particles of the solid matter are thus reduced to finest particles of a particle size of about $5\mu$ or less. To attain a good circulation of the mixture to be treated within the collecting tank, a baffle plate (7) is provided at the inner radius of the tank and a deflector member is coaxially secured to the rotor. The mixture particles accelerated by the rotor and migrating upwards along a spiral path along the inner tank wall are reversed at said baffle plate and are again supplied to the zone of intense rotor action. The cross-sectional shape of the eddy thus attained within the collecting tank is that of a lemniscate.

As soon as the colloidal mixture has been produced, the unit comprising collecting tank and motor 9 is swung into a draining position by actuating said motor 14 after said cover has been removed from the collecting tank and the ready-treated mixture is discharged from the container.

Figure 4:
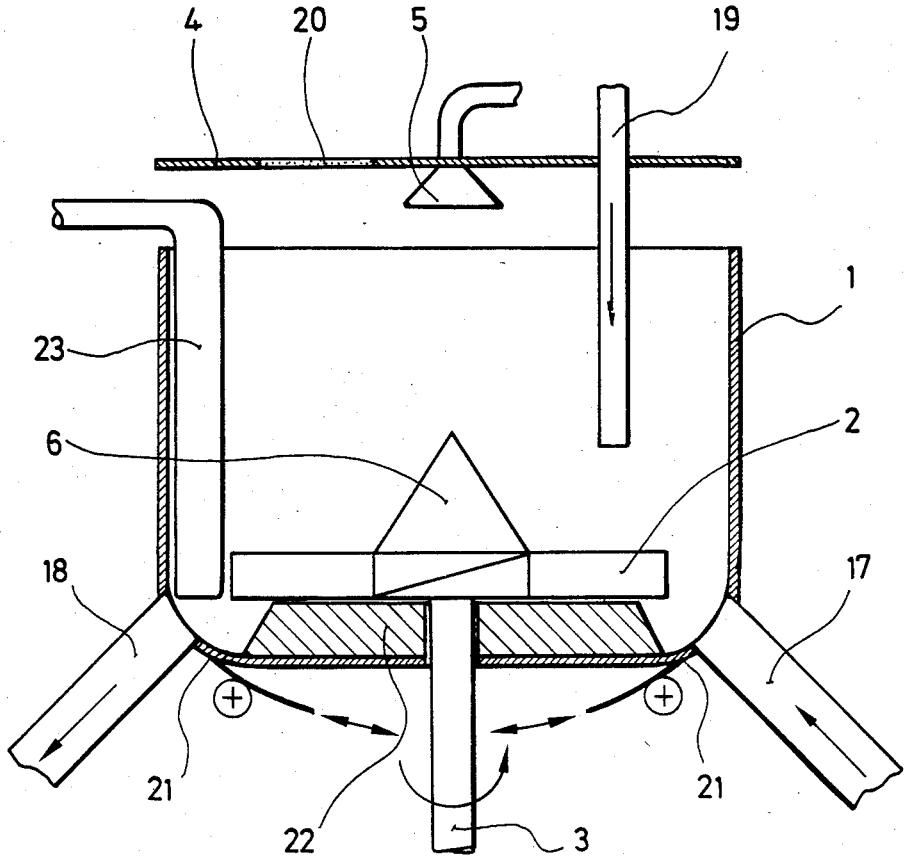
FIG. 4 is, in diagrammatic view, a longitudinal section of a third embodiment of a colloider according to the invention

FIG. 4 shows a third embodiment of the colloider according to the invention, both support and suspension of the collecting tank as well as of the rotor drive having not been described again in detail, since they have been designed as shown in FIGS. 2 and 3. In the transitional zone between side wall and bottom, the collection tank 1 illustrated in FIG. 4 is provided with a material supply system 17 and a material discharge system 18 each. Said material supply and disharge systems 17, 18 are formed as suitably dimensioned tubes which are fixedly secured to said collecting tank 1. Both material supply system 17 and material discharge system 18 are opened and closed by means of a gate 21. Said supply and discharge systems are secured to said tank and the gate is designed so as to not impair the flow behaviour of the flowable material within the collecting tank 1 interior. In addition, rotor 2 is spaced at a predetermined distance from the container bottom, which distance - as already described hereinbefore -depends upon the amount to be filled in as well as upon the filling height of the flowable material. To avoid the clearance volume below rotor 2, a substantially annulus-shaped displacement member 22 is provided, exact dimensioning of which is adapted to the individual applications. Displacement member 22 also has to be formed such that filling and draining of said collecting tank 1 via said material supply system 17 and said material discharge system 18 is not obstructed. To ensure that the collecting tank 1 including said supply and discharge systems 17, 18 can be tilted in a suitable manner about a horizontal axis as shown in FIGS. 2 and 3, said supply and discharge systems 17, 18 - and this has not been illustrated - have been integrated into the support frame 10 of the colloider. It is also possible, though, that said material supply system 17 as well as said material discharge system 18 are of a hose-like configuration to ensure that said collecting tank 1 can be tilted. FIG. 4 further shows an embodiment of cover 4 including an inspection glass 20 to enable the operating staff to look into the interior of said collecting tank 1 when said cover 4 is in its closing position. (FIG. 4 shows said cover 4 in a somewhat open position.) Both size and design of said inspection glass 20 depend upon the respective conditions, preferably, said inspection glass 20 is made of a special glass having particular scratch resistance characteristics. Furthermore, cover 4 includes a cleaning means 5 which, in a manner similar to that shown in FIGS. 2 and 3, can be used for cleaning the interior of said collecting tank 1. Such a mode of cleaning is particularly useful when the colloider is operated according to the quasi-stationary principle in the case of which it is not required to open cover 4 in the draining phase, with said rotor 2 being also continued to be driven during this phase. Cover 4 is further equipped with a material supply system 19 which movably extends through said cover 4 and is formed so as to allow loading materials to be supplied to the zone of intense rotor 2 section during the colloidizing process. Material supply system 19 is suitably movable relative to cover 4 so that the respective position of said supply system 19 can be adapted to the amount and kind of flowable material to be filled in.

In addition, a stripper member 23 is shown in FIG. 4 which is movable relative to said collecting tank 1 and is capable of removing in a spoon-like fashion the residual flowable materials from the inner walls of said collecting tank 1 after the material has been drained from the tank. During colloider operation said stripper member 23 is removed from said collecting tank 1 to not impair the flow of the flowable material. The relative movement between said stripper member 23 and said collecting tank 1 can either be realized by the provision that said stripper member is moved relative to said axis of symmetry of said collecting tank 1 or by the fact that said stripper is stationary, whereas said collecting tank 1 is caused to rotate.

Figure 5:
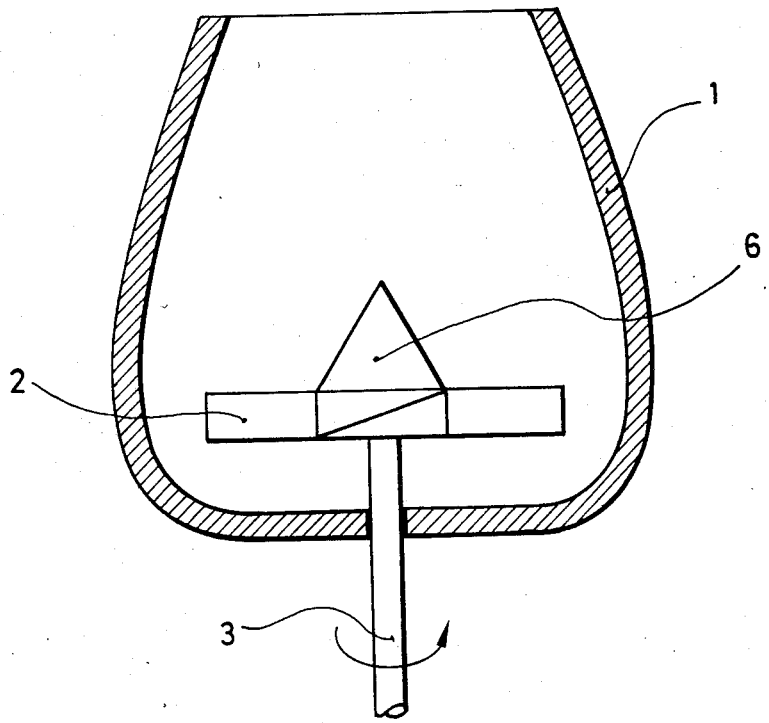
FIG. 5 is a diagrammatic view of a fourth embodiment of a colloider according to the present invention.

FIG. 5 shows a fourth embodiment of the colloider according to the invention, wherein said collecting tank 1 is of a bulged configuration. The other structural members of the colloider can be employed in such a collecting tank analogous with the members described in connection with FIGS. 2 to 4. The form of the collecting tank 1 illustrated in FIG. 5 is adapted to the flow behaviour of the flowable material and it is particularly the tank's shape tapering upwards that prevents a dead zone from being produced in the upper rim area of the side wall of said collecting tank 1; in such a dead zone material would accumulate that is not kept moving by rotor 2. Consequently, in case of such a bulged configuration of said collecting tank 1, the deflector means shown in FIGS. 2 and 3 can perhaps be dispensed with and cleaning of the collecting tank and its universal applicability being also substantially improved.

This invention is not restricted to the embodiments described hereinbefore. Without departing from essential contributions of the colloider assembly to the art made by teachings hereof various changes may be made in particular with regard to the design of the rotor and the interior of the collecting tank.

For example, the rotor may possibly be also of such a configuration that its vanes are located in two, substantially parallel planes, with three vanes being provided in each plane at an angle of approximately 120° with regard to each other and with said vanes being approximately 60° offset with regard to the respective vanes located in said other plane. An advantageous configuration of the vanes may result, depending of the field of application, from the fact that the front edge, when viewed in the direction of rotation, of the respective vane is positioned higher than the rear edge thereof, with a vacuum zone being produced on the upper side of the vane, similar to an aircraft wing, which sucks the flowable material on top of said vacuum zone toward the vane. Owing to the suction zone thus produced, it may be possible in certain cases of application to dispense with the baffle plate 7 disposed in the upper rim area of the tank 1, since the suction zone ensures reflow of the the material to the propeller.

What is claimed is:

1. A colloider for colloidizing flowable materials comprising a collection tank, a top area of which is suitably designed for receiving the materials and a rotor which is rotatably mounted on a drive shaft in a bottom area of the collecting tank and acts as an influence means, a plurality of vanes fastened to said rotor, the drive shaft of the rotor exending outwardly through the bottom of the collecting tank, said collecting tank including an opening closeable by a cover and being located in the top area of said tank, said colloider being selectively movable into an operating position, in which said opening is at the top, and into a draining position, in which said opening is at the bottom, the improvement comprising in that the ratio of the inner diameter of said collecting tank to the diameter of said rotor ranges from 1.10 to 2.25 in that the ratio of the diameter of said collecting tank to the distance between the vanes and the tank bottom ranges from 4 to 25.

2. A colloider according to claim 1 characterized in that the ratio of the height of said collecting tank (1) to its inner diameter ranges from 0.70 to 2.5.

3. A colloider according to claim 1 characterized in that the rotational speed of said rotor (2) ranges between 1.500 and 12.000 r.p.m, depending on its design.

4. A colloider accroding to claim 1 characterized in that said rotor (2) includes at least two vanes.

5. A colloider according to claim 4 characterized in that each vane is formed as a simple plate.

6. A colloider according to claim 5 characterized in that a setting angle of each vane ranges from 2° to 18°.

7. A colloider according to claim 4 characterized in that each vane has a setting angle that varies along its longitudinal extension.

8. A colloider according to claim 7 characterized in that the setting angle has a maximum value in the area of the rotation axis and decreases towards the vane tip.

9. A colloider according to claim 1 characterized in that the setting angle of said vanes is variable.

10. A colloider according to claim 1 characterized in that the ratio of the peripheral speed of said rotor (2) to the setting angle of the vanes ranges from 50 to 3.500.

11. A colloider according to claim 1 characterized in that a dynamically balanced body (6) tapering toward the tank interior is provided coaxially to said rotor (2) at that rotor side facing the interior of said collecting tank (1).

12. A colloider according to claim 1 characterized in that the distance between said rotor (2) and the collecting tank bottom is variable.

13. A colloider according to claim 1 characterized in that all vanes are located in one plane.

14. A colloider according to claim 1 characterized in that the vanes are disposed in a plurality of planes.

15. A colloider according to claim 1 characterized in that the vanes are staggered in the direction of the rotor axis such that a part of the vane facing the inner tank side and a part of an adjacent vane facing the tank bottom are located in the same plane perpendicular to said rotor axis.

16. A colloider according to claim 1 characterized in that the ratio of the vane width to the vane thickness ranges from 2 to 10.

17. A colloider according to claim 1 characterized in that said collecting tank (1) is provided with a reinforced wall portion in the area of said rotor (2).

18. A colloider according to claim 1 characterized in that said collecting tank (1) respectively comprises at least one material supply system (17) and one material discharge system (18) each adapted to be closed.

19. A colloider according to claim 18 characterized in that said material supply system (17) and said material discharge system (18) are positioned in the bottom area of said collecting tank (1).

20. A colloider according to claim 18 characterized in that said supply system (17) and said material discharge system (18) are positioned in the transitional zone between the bottom and the side wall.

21. A colloider according to claim 18 characterized in that said material supply system (17) and said material discharge system (18) are positioned in the area of the side wall.

22. A colloider according to claim 1 characterized in that a material supply system (19) is provided for feeding material into the zone of intense action of said rotor (2), with said supply system being adapted to project into said collecting tank (1) from the top.

23. A colloider according to claim 1 characterized by a vacuum pump which is adapted to be brought into cooperation with the interior of said collecting tank (1).

24. A colloider according to claim 1 characterized in that an inspection glass (20) is included in said cover (4).

25. A colloider according to claim 1 characterized in that a cleaning means (5) is provided in said cover (4).

26. A colloider according to claim 1 characterized in that a displacement member (22) is positioned between the tank bottom and said rotor (2).

27. A colloider according to claim 1 characterized in that a stripper member (23) is provided which is adapted to be introduced into said collecting tank (1) and is movable relative thereto.

28. A colloider according to claim 1 characterized in that at least one deflector means (7) is provided at the inner wall of said collecting tank (1).

29. A colloider according to claim 1 characterized in that said collecting tank (1) is of a bulged configuration.

30. A colloider according to claim 1 characterized in that said collecting tank (1), said rotor (2), said drive (3) and a motor (9) form a unit which is positioned so as to be rotatable about a horizontal axis, preferably extending through the center of gravity of said unit.

31. A colloider according to claim 30 characterized in that said collecting tank (1) and said motor (9) are coaxially arranged.

32. A colloider according to claim 30 characterized in that said collecting tank (1) is located parallel to said motor (9) and that a transmission means (15) is provided between said motor shaft and said rotor shaft (3).

* * * * *